US005900571A

United States Patent [19]

Partovi

[11] Patent Number: 5,900,571

[45] Date of Patent: May 4, 1999

[54] TWO DIMENSIONAL MUSICAL INSTRUMENT WITH THREE-QUARTER STEPS ALONG ONE DIMENSION

[76] Inventor: Rooh N. Partovi, 1898 Meridian Ave. #30, San Jose, Calif. 95125

[21] Appl. No.: 09/079,855

[22] Filed: May 15, 1998

[51] Int. Cl.[6] ..... G10G 1/02

[52] U.S. Cl. ..... 84/722; 84/622; 84/423 R; 84/428; 84/483.1

[58] Field of Search ..... 84/622, 722, 423 R, 84/424, 428, 483.1, 483.2, DIG. 30

[56] References Cited

U.S. PATENT DOCUMENTS 5,306,865 4/1994 Dinnan et al. ..... 84/622
5,404,788 4/1995 Frix ..... 84/423

OTHER PUBLICATIONS

"Music", *Encyclopaeda Britannica*, 1944, vol. 16, pp. 3–24.
Hadley, "Tuning and Temperament", *Britannica Book of Music*, 1980, pp. 823–829.
"Music", *The World Book Encyclopedia*, 1982, vol. 13, pp. 786–798.
"Musical Acoustics", *Encyclopedia of Science & Technology*, McGraw–Hill Book Company, 1982, pp. 826–837.

*Primary Examiner*—William M. Shoop, Jr.
*Assistant Examiner*—Marlon T. Fletcher
*Attorney, Agent, or Firm*—Donald W. Marks

[57] ABSTRACT

A musical instrument includes a two-dimension array of note producing elements wherein the elements along one dimension of the array have three-quarter steps or increasing fundamental frequencies $F_n$ according to the equation $$F_n = F_0 * 2^{n/8}$$

wherein $F_0$ is the fundamental frequency of the first note producing element in the one dimension and n is the number of the note producing element in the one direction from the first note producing element. The note producing elements along a second dimension of the array have fundamental frequencies which differ by frequency differences (such as perfect fourth intervals) greater than the frequency differences between adjacent note producing elements along the one dimension of the array.

12 Claims, 13 Drawing Sheets

Increasing Fundamental Frequency $F_n$ ($F_n = F_0 * 2^{5n/12}$)

| | | | | | | | | |
|---|---|---|---|---|---|---|---|---|
| 32.000 | 34.896 | 38.055 | 41.499 | 45.255 | 49.351 | 53.817 | 58.688 | 64.000 |
| 23.973 | 26.143 | 28.509 | 31.089 | 33.903 | 36.971 | 40.317 | 43.967 | 47.946 |
| 17.959 | 19.585 | 21.357 | 23.290 | 25.398 | 27.697 | 30.204 | 32.938 | 35.919 |
| 13.454 | 14.672 | 16.000 | 17.448 | 19.027 | 20.749 | 22.627 | 24.675 | 26.909 |
| 10.079 | 10.992 | 11.986 | 13.071 | 14.254 | 15.545 | 16.951 | 18.486 | 20.159 |
| 7.551 | 8.234 | 8.980 | 9.792 | 10.679 | 11.645 | 12.699 | 13.849 | 15.102 |
| 5.657 | 6.169 | 6.727 | 7.336 | 8.000 | 8.724 | 9.514 | 10.375 | 11.314 |
| 4.238 | 4.621 | 5.040 | 5.496 | 5.993 | 6.536 | 7.127 | 7.772 | 8.476 |
| 3.175 | 3.462 | 3.775 | 4.117 | 4.490 | 4.896 | 5.339 | 5.823 | 6.350 |
| 2.378 | 2.594 | 2.828 | 3.084 | 3.364 | 3.668 | 4.000 | 4.362 | 4.757 |
| 1.782 | 1.943 | 2.119 | 2.311 | 2.520 | 2.748 | 2.997 | 3.268 | 3.564 |
| 1.335 | 1.456 | 1.587 | 1.731 | 1.888 | 2.059 | 2.245 | 2.448 | 2.670 |
| 1.000 | 1.091 | 1.189 | 1.297 | 1.414 | 1.542 | 1.682 | 1.834 | 2.000 |

Increasing Fundamental Frequency $F_n$ ($F_n = F_0 * 2^{n/8}$)

RELATIVE FREQUENCY RELATIONSHIPS

FIG. 1A

Increasing Fundamental Frequency $F_n$ ($F_n = F_0 * 2^{5n/12}$)

| | | | | | | | | |
|---|---|---|---|---|---|---|---|---|
| 64.000 | 69.792 | 76.109 | 82.998 | 90.510 | 98.701 | 107.635 | 117.377 | 128.000 |
| 47.946 | 52.285 | 57.018 | 62.178 | 67.806 | 73.943 | 80.635 | 87.933 | 95.892 |
| 35.919 | 39.170 | 42.715 | 46.581 | 50.797 | 55.394 | 60.408 | 65.875 | 71.838 |
| 26.909 | 29.344 | 32.000 | 34.896 | 38.055 | 41.499 | 45.255 | 49.351 | 53.817 |
| 20.159 | 21.983 | 23.973 | 26.143 | 28.509 | 31.089 | 33.903 | 36.971 | 40.317 |
| 15.102 | 16.469 | 17.959 | 19.585 | 21.357 | 23.290 | 25.398 | 27.697 | 30.204 |
| 11.314 | 12.338 | 13.454 | 14.672 | 16.000 | 17.448 | 19.027 | 20.749 | 22.627 |
| 8.476 | 9.243 | 10.079 | 10.992 | 11.986 | 13.071 | 14.254 | 15.545 | 16.951 |
| 6.350 | 6.924 | 7.551 | 8.234 | 8.980 | 9.792 | 10.679 | 11.645 | 12.699 |
| 4.757 | 5.187 | 5.657 | 6.169 | 6.727 | 7.336 | 8.000 | 8.724 | 9.514 |
| 3.564 | 3.886 | 4.238 | 4.621 | 5.040 | 5.496 | 5.993 | 6.536 | 7.127 |
| 2.670 | 2.911 | 3.175 | 3.462 | 3.775 | 4.117 | 4.490 | 4.896 | 5.339 |
| 2.000 | 2.181 | 2.378 | 2.594 | 2.828 | 3.084 | 3.364 | 3.668 | 4.000 |

Increasing Fundamental Frequency $F_n$ ($F_n = F_0 * 2^{n/8}$)

RELATIVE FREQUENCY RELATIONSHIPS

FIG. 1B

Increasing Fundamental Frequency $F_n$ ($F_n = F_0 * 2^{5n/12}$)

| | | | | | | | | |
|---|---|---|---|---|---|---|---|---|
| 128.000 | 139.585 | 152.219 | 165.995 | 181.019 | 197.403 | 215.269 | 234.753 | 256.000 |
| 95.892 | 104.571 | 114.035 | 124.356 | 135.611 | 147.885 | 161.270 | 175.866 | 191.783 |
| 71.838 | 78.339 | 85.430 | 93.162 | 101.594 | 110.789 | 120.816 | 131.751 | 143.675 |
| 53.817 | 58.688 | 64.000 | 69.792 | 76.109 | 82.998 | 90.510 | 98.701 | 107.635 |
| 40.317 | 43.967 | 47.946 | 52.285 | 57.018 | 62.178 | 67.806 | 73.943 | 80.635 |
| 30.204 | 32.938 | 35.919 | 39.170 | 42.715 | 46.581 | 50.797 | 55.394 | 60.408 |
| 22.627 | 24.675 | 26.909 | 29.344 | 32.000 | 34.896 | 38.055 | 41.499 | 45.255 |
| 16.951 | 18.486 | 20.159 | 21.983 | 23.973 | 26.143 | 28.509 | 31.089 | 33.903 |
| 12.699 | 13.849 | 15.102 | 16.469 | 17.959 | 19.585 | 21.357 | 23.290 | 25.398 |
| 9.514 | 10.375 | 11.314 | 12.338 | 13.454 | 14.672 | 16.000 | 17.448 | 19.027 |
| 7.127 | 7.772 | 8.476 | 9.243 | 10.079 | 10.992 | 11.986 | 13.071 | 14.254 |
| 5.339 | 5.823 | 6.350 | 6.924 | 7.551 | 8.234 | 8.980 | 9.792 | 10.679 |
| 4.000 | 4.362 | 4.757 | 5.187 | 5.657 | 6.169 | 6.727 | 7.336 | 8.000 |

Increasing Fundamental Frequency $F_n$ ($F_n = F_0 * 2^{n/8}$)

RELATIVE FREQUENCY RELATIONSHIPS

FIG. 1C

| | | | | | | | | | | | | | | | | | |
|---|---|---|---|---|---|---|---|---|---|---|---|---|---|---|---|---|---|
| Fa♯/F# | 32.0 | Sol>/G> | 34.9 | La/A | 38.1 | Ti</B< | 41.5 | Do/C | 45.3 | Re</D< | 49.4 | Re♯/D♯ | 53.8 | Mi>/E> | 58.7 | Fa#/F ♯ | 64.0 |
| Do♯/C♯ | 24.0 | Re>/D> | 26.1 | Mi/E | 28.5 | Fa>/F> | 31.1 | Sol/G | 33.9 | La</A< | 37.0 | La♯/A♯ | 40.3 | Do</C< | 44.0 | Do♯/C♯ | 47.9 |
| Sol♯/G♯ | 18.0 | La>/A> | 19.6 | Ti/B | 21.4 | Do>/C> | 23.3 | Re/D | 25.4 | Mi</E< | 27.7 | Fa/F | 30.2 | Sol</G< | 32.9 | Sol♯/G♯ | 35.9 |
| Re♯/D♯ | 13.5 | Mi>/E> | 14.7 | Fa♯/F♯ | 16.0 | Sol>/G> | 17.4 | La/A | 19.0 | Ti</B< | 20.7 | Do/C | 22.6 | Re</D< | 24.7 | Re♯/D♯ | 26.9 |
| La♯/A♯ | 10.1 | Ti>/B> | 11.0 | Do♯/C♯ | 12.0 | Re>/D> | 13.1 | Mi/E | 14.3 | Fa>/F> | 15.5 | Sol/G | 17.0 | La</A< | 18.5 | La♯/A♯ | 20.2 |
| Fa/F | 7.6 | Sol</G< | 8.2 | Sol♯/G♯ | 9.0 | La>/A> | 9.8 | Ti/B | 10.7 | Do>/C> | 11.6 | Re/D | 12.7 | Mi</E< | 13.8 | Fa/F | 15.1 |
| Do/C | 5.7 | Re</D< | 6.2 | Re♯/D♯ | 6.7 | Mi>/E> | 7.3 | Fa♯/F♯ | 8.0 | Sol>/G> | 8.7 | La/A | 9.5 | Ti</B< | 10.4 | Do/C | 11.3 |
| Sol/G | 4.2 | La</A< | 4.6 | La♯/A♯ | 5.0 | Do</C< | 5.5 | Do♯/C♯ | 6.0 | Re>/D> | 6.5 | Mi/E | 7.1 | Fa>/F> | 7.8 | Sol/G | 8.5 |
| Re/D | 3.2 | Mi</E< | 3.5 | Fa/F | 3.8 | Sol</G< | 4.1 | Sol♯/G♯ | 4.5 | La>/A> | 4.9 | Ti/B | 5.3 | Do>/C> | 5.8 | Re/D | 6.3 |
| La/A | 2.4 | Ti</B< | 2.6 | Do/C | 2.8 | Re</D< | 3.1 | Re♯/D♯ | 3.4 | Mi>/E> | 3.7 | Fa♯/F♯ | 4.0 | Sol>/G> | 4.4 | La/A | 4.8 |
| Mi/E | 1.8 | Fa>/F> | 1.9 | Sol/G | 2.1 | La</A< | 2.3 | La♯/A♯ | 2.5 | Ti>/B> | 2.7 | Do♯/C♯ | 3.0 | Re>/D> | 3.3 | Mi/E | 3.6 |
| Ti/B | 1.3 | Do>/C> | 1.5 | Re/D | 1.6 | Mi</E< | 1.7 | Fa/F | 1.9 | Sol</G< | 2.1 | Sol♯/G♯ | 2.2 | La>/A> | 2.4 | Ti/B | 2.7 |
| Fa♯/F# | 1.0 | Sol>/G> | 1.1 | La/A | 1.2 | Ti</B< | 1.3 | Do/C | 1.4 | Re</D< | 1.5 | Re♯/D♯ | 1.7 | Mi>/E> | 1.8 | Fa#/F ♯ | 2.0 |

"♯" = one-half step up
"♭" = one-half step down
">" = one-quarter step up
"<" = one-quarter step down

FIG. 2

| | | | | | | | | | | | | | | | | | |
|---|---|---|---|---|---|---|---|---|---|---|---|---|---|---|---|---|---|
| Me/E | 330 | Fa>/F> | 360 | Sol/G | 392 | La</A< | 427 | La#/A# | 466 | Ti>/B> | 508 | Do#/C# | 554 | Re>/D> | 605 | Mi/e | 659 |
| -0.5 | | 0.25 | | 1 | | 1.75 | | 2.5 | | 3.25 | | 4 | | 4.75 | | 5.5 | |
| Ti/B | 247 | Do>/C> | 269 | Re/D | 294 | Mi</E< | 320 | Fa/F | 349 | Sol</G< | 381 | Sol#/G# | 415 | LA>/A> | 453 | Ti/B | 494 |
| | | | | | | -0.75 | | 0 | | 0.75 | | 1.5 | | 2.25 | | 3 | |
| Fa#/F# | 185 | Sol>/G> | 202 | La/A | 220 | Ti</B< | 240 | Do/C | 262 | Re</D< | 285 | Re#/D# | 311 | Mi>/E> | 339 | Fa#/F# | 369 |
| | | | | | | | | | | | | | | -0.25 | | 0.5 | |

FIG. 3A

| | | | | | | | | | | | | | | | | | |
|---|---|---|---|---|---|---|---|---|---|---|---|---|---|---|---|---|---|
| Me/E | 649 | Fa>/F> | 718 | Sol/G | 784 | La</A< | 854 | La#/A# | 932 | Ti>/B> | 1016 | Do#/C# | 1109 | Re>/D> | 1209 | Mi/e | 1318 |
| 5.5 | | 6.25 | | | | | | | | | | | | | | | |
| Ti/B | 494 | Do>/C> | 539 | Re/D | 587 | Mi</E< | 640 | Fa/F | 698 | Sol</G< | 761 | Sol#/G# | 831 | La>/A> | 905 | Ti/B | 987 |
| 3 | | 3.75 | | 4.5 | | 5.25 | | 6 | | | | | | | | | |
| Fa#/F# | 369 | Sol>/G> | 403 | La/A | 440 | Ti</B< | 480 | Do/C | 523 | Re</D< | 570 | Re#/D# | 622 | Mi>/E> | 679 | Fa#/F# | 739 |
| 0.5 | | 1.25 | | 2 | | 2.75 | | 3.5 | | 4.25 | | 5 | | 5.75 | | 6.5 | |

FIG. 3B

| LEFT BRIDGE UP | | RIGHT BRIDGE UP | |
|---|---|---|---|
| Fa#/F# | Fa#/F# | Ti/B | Mi/E |
| Mi>/E> | Mi>/E> | La>/A> | Re>/D> |
| Re#/D# | Re#/D# | Sol#/G# | Do#/C# |
| Re</D< | Re</D< | Sol</G< | Ti>/B> |
| Do/C | Do/C | Fa/F | La#/A# |
| Ti</B< | Ti</B< | Mi</E< | La</A< |
| La/A | La/A | Re/D | Sol/G |
| Sol>/G> | Sol>/G> | Do>/C> | Fa>/F> |
| Fa#/F# | Fa#/F# | Ti/B | Mi/E |

72

| n | $L_{2n-1}$ | $L_{2n}$ | $\Delta D_{10+n}$ | $\Delta D_{20+n}$ |
|---|---|---|---|---|
| 1 | 1 | 0.9576 | $0.1660 * D_1$ | $0.1660 * D_2$ |
| 2 | 0.917 | 0.8781 | $0.1522 * D_1$ | $0.1522 * D_2$ |
| 3 | 0.8409 | 0.8052 | $0.1396 * D_1$ | $0.1396 * D_2$ |
| 4 | 0.7711 | 0,7384 | $0.1280 * D_1$ | $0.1280 * D_2$ |
| 5 | 0.7071 | 0.6771 | $0.1174 * D_1$ | $0.1174 * D_2$ |
| 6 | 0.6484 | 0.6209 | $0.1076 * D_1$ | $0.1076 * D_2$ |
| 7 | 0.5946 | 0.5694 | $0.0987 * D_1$ | $0.0987 * D_2$ |
| 8 | 0.5453 | 0.5221 | $0.0905 * D_1$ | $0.0905 * D_2$ |
| 9 | 0.5000 | 0.4788 | | |

TWO DIMENSIONAL MUSICAL INSTRUMENT WITH THREE-QUARTER STEPS ALONG ONE DIMENSION

TECHNICAL FIELD

The present invention relates to musical systems and instruments for producing music employing a two-dimensional array of note producing elements, such as a two-dimensional array of keys for operating devices to produce musical notes or a plurality of parallel strings with transverse frets or bridges defining a two-dimensional array of note-producing elements.

BACKGROUND ART

Pythagoras has been attributed with the development of a musical scale based upon harmony or consonance between two musical notes (interval) when the higher note relative to the lower note is an eighth (octave—frequency ratio 2:1), a fifth (frequency ratio 3:2) or a fourth (frequency ratio 4:3). Lesser consonant sixth (frequency ratio 5:3) and third (frequency ratio 5:4) and generally dissonant second (frequency ratio 9:8) and seventh (frequency ratio 15:8) complete the scale known as the seven note diatonic scale labeled with the seven letters A, B, C, D, E, F and G. Each eighth note or octave begins a new series. The diatonic scale evolved into the twelve note chromatic scale commonly used today wherein semitones or half steps are added between the notes with larger intervals, i.e., A#, C#, D#, F# and G#, to form a scale entirely of half steps.

Each note or music tone contains a fundamental frequency (first partial) together with a plurality of harmonic frequencies (second, third, etc., partials). The consonance or dissonance (harmony or harshness) between two simultaneous notes (interval) generally depends upon the interactions of the partials of one note with the other note. Dissonance occurs when there is a small frequency difference between two partials. Differences in the range from about three to ten hertz produce audible beats while somewhat larger frequency differences, depending upon the frequency, also produce harshness. For an octave interval, all the partials of the higher note coincide with partials of the lower note producing a high degree of consonance. For a fifth interval, the second, fourth, sixth, etc. partials of the higher note coincide with the third, fifth, seventh, etc. partials of the lower note while the differences between the other partials are sufficient to avoid dissonance thus producing consonance. For a fourth interval, the third, sixth, ninth, etc. partials of the higher note coincide with the fourth, seventh, tenth, etc. partials of the lower note while the differences between the other partials are sufficient to avoid dissonance thus producing consonance. Eighths, fifths and fourths are called perfect intervals because of their consonance.

Generally the fundamental frequencies F(n) in the twelve note chromatic scale are in accordance with the equation $$F_n = F_0 * 2^{n/12}$$

wherein $F_0$ is the first frequency of the scale and n is the number of the note from $F_0$. It is noted that this equation does not give the exact relationship 3:2 for a fifth (n=7) or 4:3 for a fourth (n=5) but is sufficiently close to be considered consonant and is herein considered the same.

Musical instruments having keyboards for producing notes normally include a linear array of white keys arranged in the diatonic scale with raised black keys disposed between the rear portions of selected white keys for adding the half steps to complete the twelve note chromatic scale. One type of keyboard instrument has an electronic note generator which responds to a depressed key to produce the corresponding musical note.

String instruments, such as a guitar, violin, cello, string bass, etc., have a plurality of parallel strings with a plurality of frets extending perpendicular to the strings so that each string can be held against a fret to increase the vibration frequency of each string. The spacing of the frets is generally designed to produce half-step changes in string frequency in accordance with the chromatic scale when the string is pressed against successive frets (stopped). The masses and tensions of the different strings are selected to produce intervals such as fourths, fifths, etc. between strings. The spacing of frets on conventional string instruments with one-half step produces corresponding stopped string lengths L(n) of $$L(n) = \frac{L_0}{2^{(n/12)}}$$

wherein $L_0$ is the length of the unstopped string and n is the number of the fret from the distal end of the finger board.

Another type of string instrument known as the hammer dulcimer has a plurality of parallel strings of different lengths defining half steps. Engageable left and right bridges define left and right string portions for producing intervals equal to one or two octaves.

Various scales other than the twelve note chromatic scale of half notes have been used in musical instruments. Among these are seventeen, twenty-two and twenty-four note scales. The twenty-four note scale consists of quarter steps and, if adopted, would provide musicians with many additional musical effects from intervals, chords, and other multiple note combinations. Pentatonic scales have been employed in music and include five notes per octave based upon fourth intervals.

SUMMARY OF INVENTION

An object of the present invention is to provide a musical instrument employing a two-dimensional array of note-producing elements which can produce various scales including conventional scales.

Another object of the present invention is to provide a musical instrument which can be made compact and used to demonstrate the interaction between various notes of conventional scales.

In accordance with these and other objects, the present invention is summarized in a musical instrument having a two dimensional array of note producing elements wherein the note producing elements in one direction along one dimension of the array include at least eight note producing elements having increasing fundamental frequencies $F_n$ according to the equation $$F_n = F_0 * 2^{n/8} \quad \text{(three-quarter step)}$$

wherein $F_0$ is the fundamental frequency of the first note producing element in the one dimension and n is the number of the note producing element in the one direction from the first note producing element. The note producing elements along a second dimension of the array have fundamental frequencies which differ by greater frequency differences than the frequency differences between adjacent note producing elements along the one dimension of the array.

One advantage of the present invention is that scales, intervals, chords and other interactions between notes based upon various conventional music scales can be demonstrated.

Additional features of the present invention include the provision of fundamental frequencies of note producing elements along the second dimension differing by the multiplier $2^{5/12}$ (fourth); the provision of a two dimensional keyboard and a note generator responsive to depression of each key of the keyboard for generating a corresponding note; a two-dimensional array of note producing elements in a string instrument having a plurality of parallel strings and a plurality of members such as frets or engageable bridges transverse to the strings for changing the vibrating length of the strings; a hammer dulcimer having alternate strings forming two series with bridges positioned to form respective different intervals wherein each series of strings produce three-quarter steps; and a hammer dulcimer wherein string segments of one series form fourths with adjacent string segments of a second series.

Other objects, advantages and features of the invention will be apparent from the following description of the preferred embodiments and the accompanying drawings.

BRIEF DESCRIPTION OF DRAWINGS

FIGS. 1A, 1B an 1C are successive sections of a two-dimensional table illustrating relative frequency relationships employed in two-dimensional arrays of note elements in musical instruments in accordance with the present invention.

FIG. 2 is a two-dimensional table containing a portion of the table of FIGS. 1A, 1B and 1C with note symbols A through G added to illustrate notes.

FIGS. 3A and 3B are respective portions of a two-dimensional table in accordance with FIGS. 1A, 1B, 1C and 2 identifying actual frequencies and notes with note symbols A through G along with a bold printed number indicating a step position relative to F above middle C.

DESCRIPTION OF THE PREFERRED EMBODIMENTS

A musical instrument in accordance with the invention has a two-dimensional array of elements for producing notes wherein elements along one dimension of the array produce musical notes of increasing fundamental frequency $F_n$ according to the equation $$F_n = F_0 * 2^{n/8}$$

wherein $F_0$ is the fundamental frequency of the first note producing element in the one dimension and n is the number of the note producing element in the one direction from the first note producing element. For example in FIG. 1, each succeeding relative fundamental frequency in each row (X direction) is $2^{1/8}$ or 1.0905 times the proceeding relative fundamental frequency. This corresponds to a three-quarter (¾) step relative to the one-half (½) step between notes in the conventional twelve note chromatic scale. Each octave in the X direction contains eight notes as opposed to the twelve notes contained in each octave of the chromatic scale. In the other dimension (columns or Y direction in FIG. 1) each succeeding note in the second direction (upward in FIG. 1) increases by $2^{5/12}$ or 1.335 times the preceding note. Thus the notes $F_Y$ in the second or Y direction have fundamental frequencies according to the equation $$F_n = F_0 * 2^{5n/12} \quad \text{(perfect fourth)}$$

wherein $F_0$ is the fundamental frequency of the first note producing element in the second dimension and n is the number of the note producing element in the second direction from the first note producing element. Each step in the second direction corresponds to the perfect fourth interval in the conventional diatonic scale.

Referring to FIG. 2, the relative fundamental frequencies of notes in one octave are assigned notations (La, Ti, Do, Re, Me, Fa, Sol)/(A, B, C, D, E, F, G) corresponding to the conventional notations in the twelve note chromatic scale with the extensions of the symbol "<" to indicate a quarter step lower and the symbol ">" to indicate a quarter step higher. The symbol "#" is used in the conventional manner of indicating a half-step higher and the conventional symbol "♭" indicates a half-step lower.

In FIGS. 3A and 3B, the relative fundamental frequencies are replaced by actual frequencies with the "A" above middle "C" being assigned 440 Hertz or cycles per second. The table extends two octaves in the X direction but only three rows in the Y direction. Additionally, there are added bold numbers indicating step portions based upon the conventional "half step" spacing of the chromatic scale. These bold numbers indicate that a complete twenty-four note musical scale of quarter steps can be formed by a two-dimensional array of three-quarter steps in one dimension and intervals of two and one-half steps in the second dimension using only three rows (fourth intervals) and two octaves of three-quarter steps.

Figure 4:
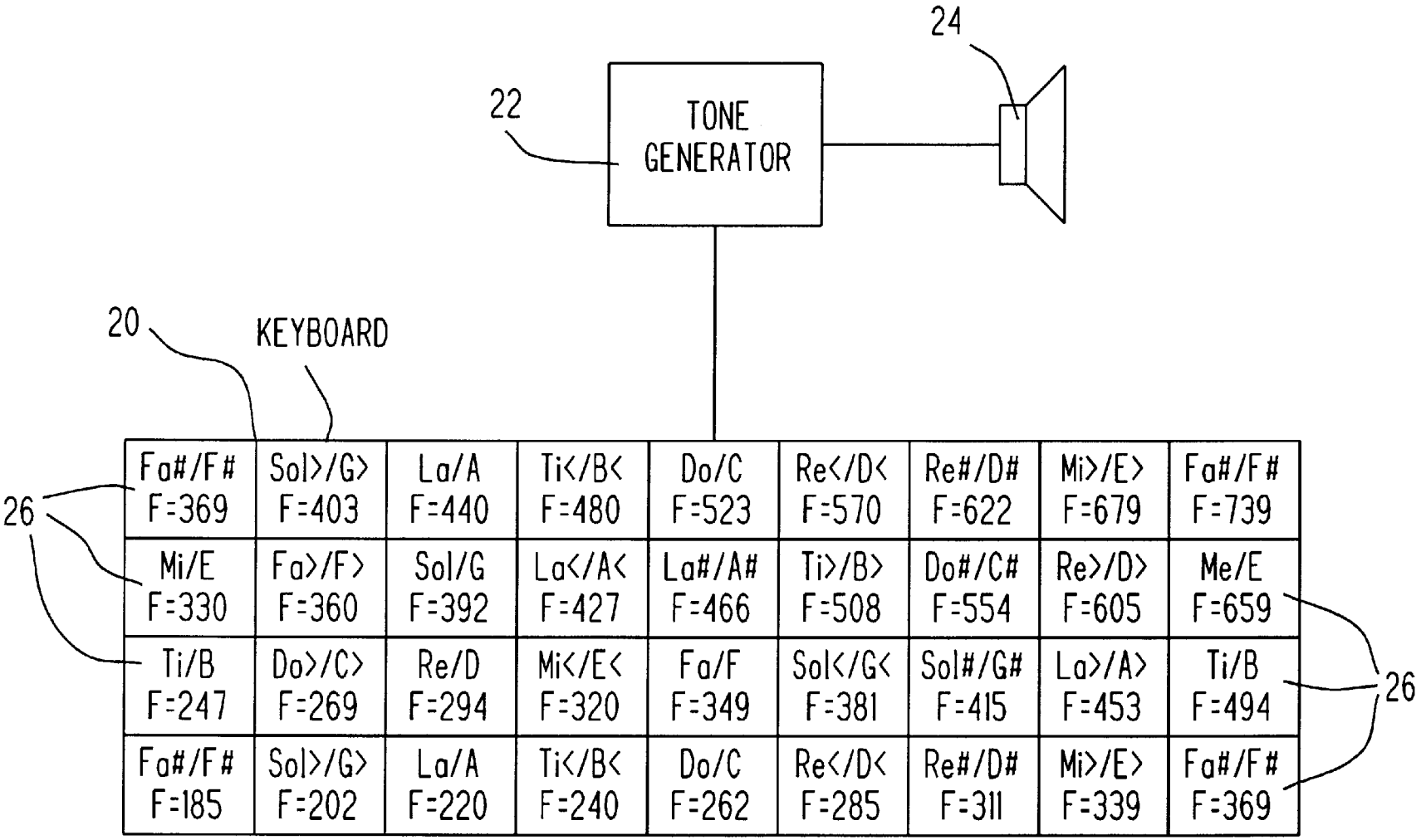
FIG. 4 is a diagram of a musical instrument with a two-dimensional keyboard in accordance with the present invention.

As shown in FIG. 4, a musical instrument in accordance with one embodiment includes a keyboard 20 connected to a tone generator 22 which drives a speaker 24 to broadcast notes corresponding to depressed keys of the keyboard. The keyboard 20 includes a two-dimensional array of keys 26 arranged, for example, in four rows and nine columns. When one or more of the keys 26 are depressed, the tone generator 22 produces the fundamental frequency or frequencies (as noted on the keys) corresponding to the depressed key or keys along with a plurality of harmonic frequencies of each fundamental frequency to form musical notes, intervals, chords, etc. Each musical note produced by the tone generator includes preferably at least four or more partials and can be a stored digitized record of actual notes produced by a musical instrument, or can be synthetically generated.

Figure 9:
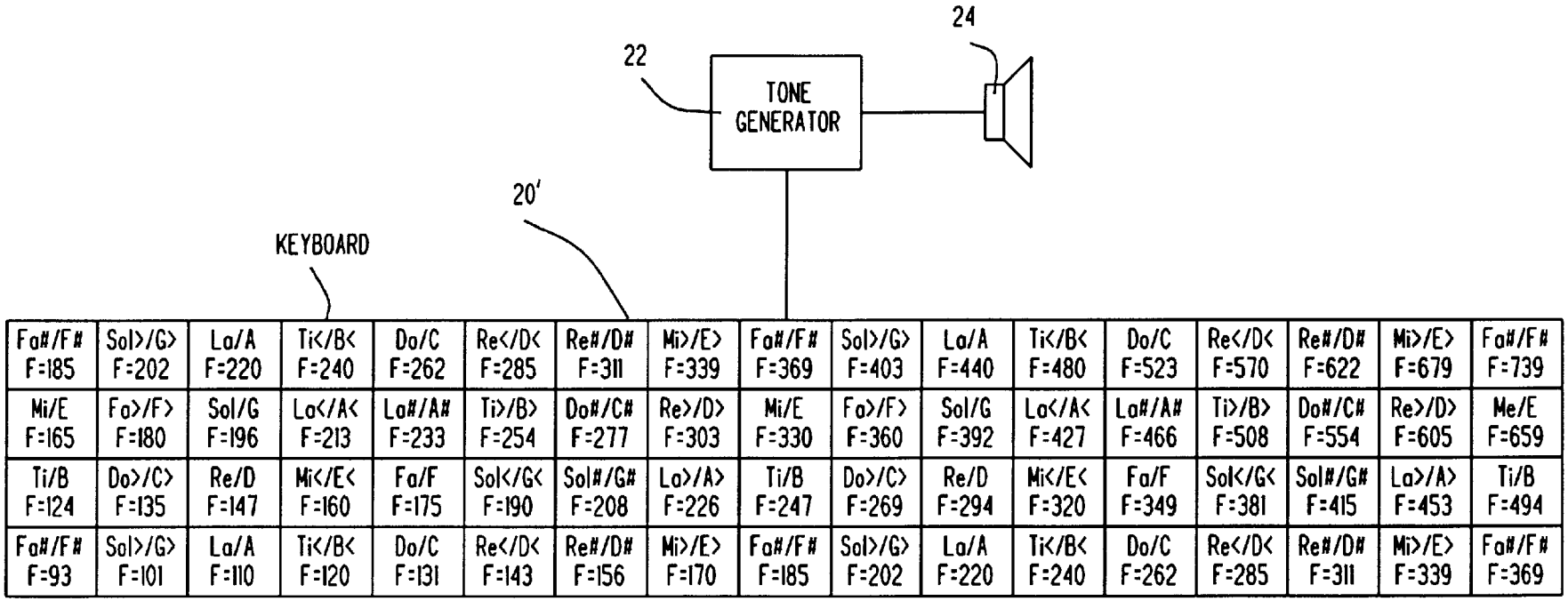
FIG. 9 is a diagram of an electronic musical instrument similar to FIG. 4 but with an expanded keyboard.

The keyboard illustrated in FIG. 4 shows only one octave of three-quarter step keys in the X direction with three rows in the Y direction having steps of perfect fourth intervals and a fourth row (top row) which is an octave (perfect eighth) above the first row (bottom row). Keyboards with more columns and/or rows can be employed. For example FIG. 9 illustrates a keyboard 20' with two octaves in the X direction. Various other intervals between keys in adjacent rows can be employed or keys in rows can be shifted in the +X or −X direction relative to keys in other rows.

Figure 5:
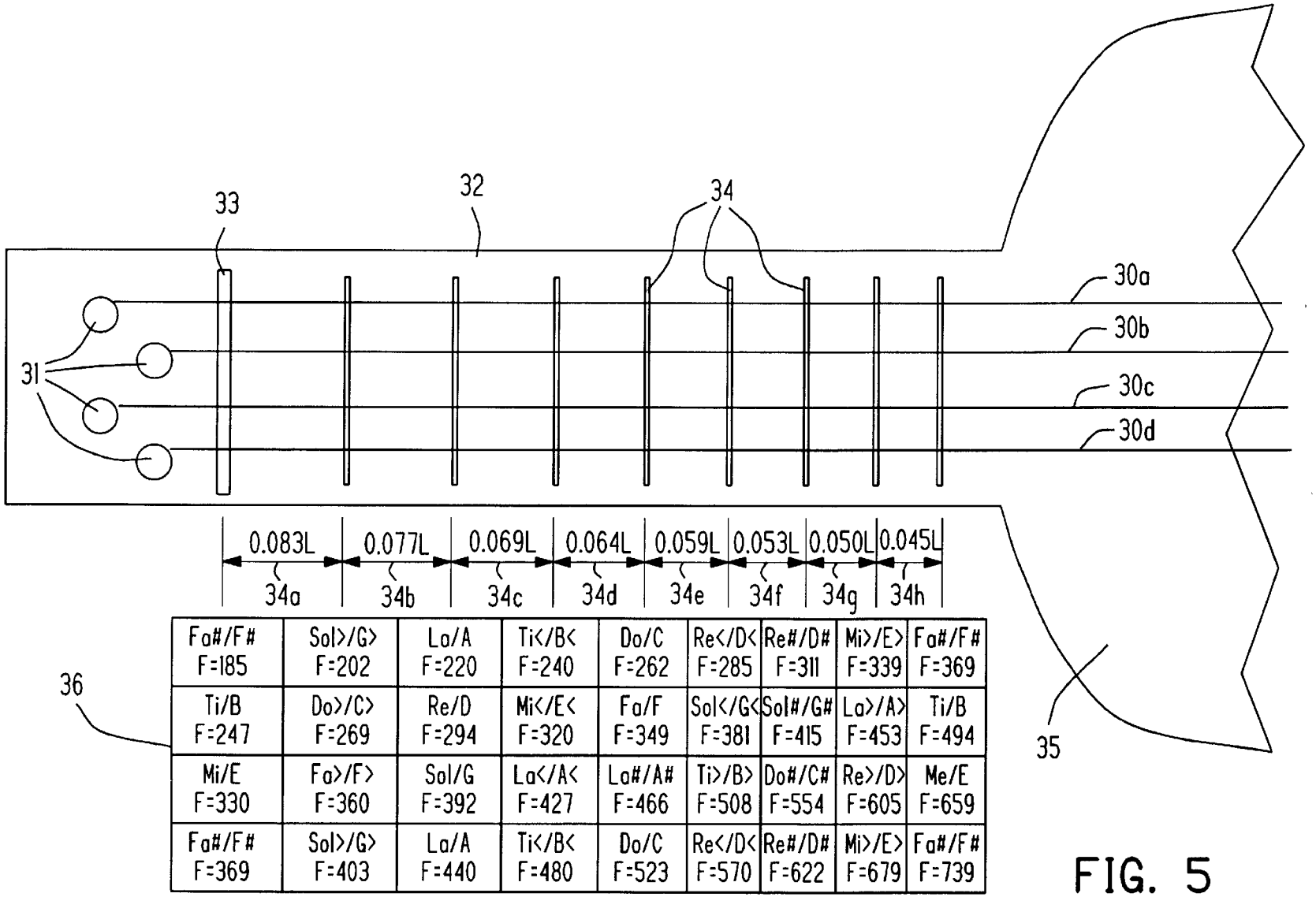
FIG. 5 is a plan view of a broken-away portion of string instrument forming a two-dimensional array of note producing elements together with a table in accordance with the invention.

As shown in FIG. 5, a musical string instrument in accordance with a second embodiment of the invention includes a plurality of parallel strings 30*a*–30*d* secured at one ends by tensioning devices 31 on the distal end of a fingerboard 32. The strings 30*a*–30*d* engage a bridge 33 adjacent the tensioning devices and extend above a plurality of successively spaced frets 34 on the fingerboard which are transverse or perpendicular to the strings. The fingerboard 32 is mounted on a music box 35 over which the strings extend to suitable conventional fastening means (not shown) on the music box. The distances 34*a*–34*h* between the corresponding pairs of frets 34 are selected so that when a string is pressed against a fret (stopped) the length L(n) of the stopped string (i.e., the length of the string extending from the engaged fret to the bridge (not shown) on the music box) is in accordance with the equation $$L(n) = \frac{L}{2^{n/8}}$$

wherein L is the length of the unstopped string between the bridges and n is the number of the fret 34 from the left bridge 33. The relative distances between the successive frets 34 are shown in FIG. 5 above arrowed lines 34*a*–34*h* and are based upon the total length L of the string extending between bridges on the fingerboard and music box and produce three-quarter steps between successive notes. The frets along one dimension of the array produce musical notes of increasing fundamental frequency $F_n$ according to the equation $$F_n = F_0 * 2^{n/8}$$

wherein $F_0$ is the fundamental frequency of the string without any fret being engaged and n is the number of the fret in the one direction from the bridge or first note producing element. The masses and tensions of the strings 30*a*–30*d* are selected so that intervals between the three upper strings 30*a*, 30*b* and 30*c* are perfect fourths with the lowest string 30*d* being an octave above the uppermost string 30*a*.

Table 36 sets forth an example of frequencies and notes produced by the two-dimensional array of note producing elements formed by the strings 30*a*–30*d* and frets 34. The string instrument of FIG. 5 can be constructed with more than four strings and/or with different string intervals. Additionally more frets can be used to provide more than one octave of three-quarter steps.

Figure 6:
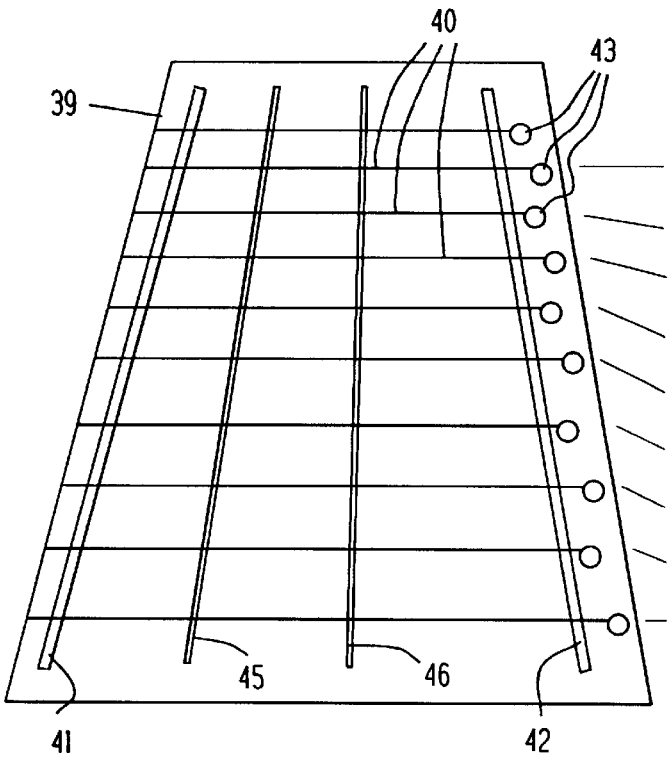
FIG. 6 is a plan view of a second type of string instrument forming a two-dimensional array of note producing elements together with a table in accordance with the invention.
Figure 7:
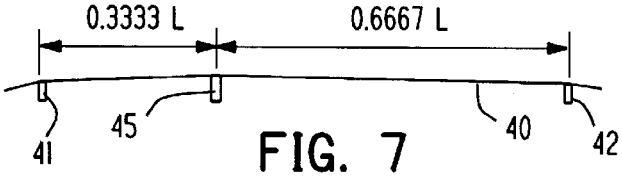
FIG. 7 is a front view of a string with a left bridge raised in the instrument of FIG. 6.
Figure 8:
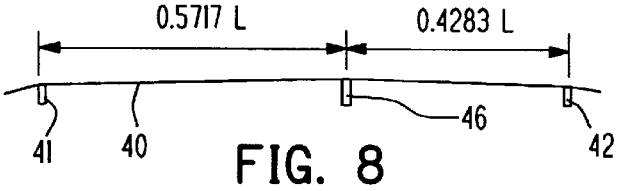
FIG. 8 is a front view of a string with a right bridge raised in the instrument of FIG. 6.

In FIG. 6, a hammer dulcimer constructed in accordance with a third embodiment of the invention includes a trapezoidal board or frame 39 with a plurality of parallel strings 40 which are held in engagement with side bridges 41 and 42 by tensioning devices 43 on the right side of the board 39 and by being suitable fastened at the left side edge of the board 39. The strings 40 have lengths, masses and/or tensions producing increasing notes from bottom to top of three-quarter steps. The strings 40 produce musical notes of increasing fundamental frequency $F_n$ according to the equation $$F_n = F_0 * 2^{n/8}$$

wherein $F_0$ is the fundamental frequency of the lowermost string and n is the number of the string in the one direction (upward) from the bottom string or first note producing element. The dulcimer includes left and right engageable bridges 45 and 46 which can be alternatively raised into engage the strings 40 and form pairs of note producing string portions of each string. As shown in FIG. 7, the left bridge 42, when engaged, divides the strings into sections producing notes with an octave interval. When the right bridge 46 is engaged as illustrated in FIG. 8, the string 40 is divided into sections producing notes having a perfect fourth interval. Table 48 in FIG. 6 sets forth an example of notes produced by the dulcimer and its string sections when the corresponding bridges are raised.

The dulcimer of FIG. 6 can include more strings with three-quarter steps and/or one or more of the engageable bridges 45 and 46 can have a position producing a different interval between string sections.

Figure 10:
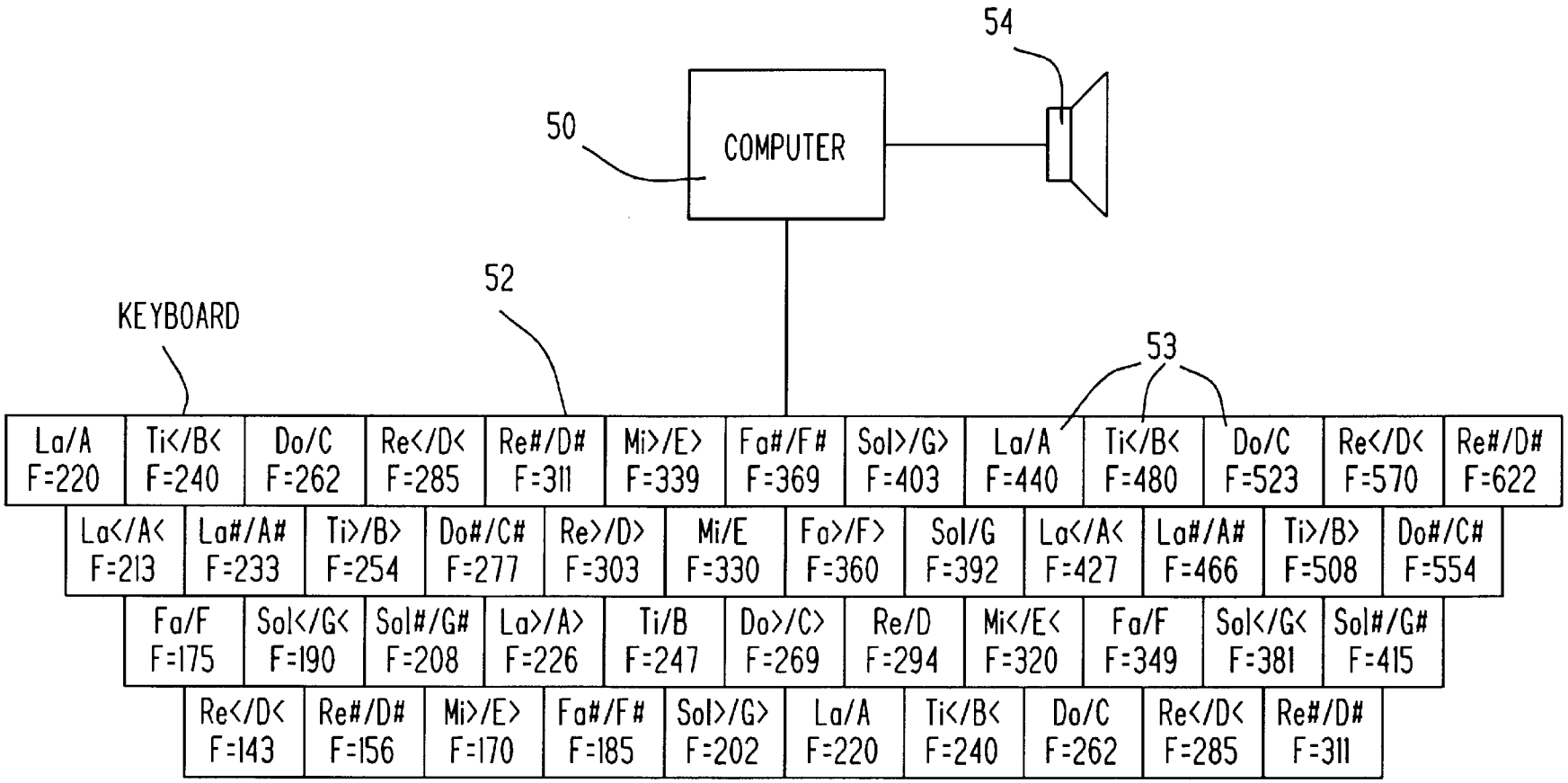
FIG. 10 is a diagram of an electronic musical instrument similar to FIG. 4 but employing a conventional computer with a computer keyboard.

In a fourth embodiment of the invention as shown in FIG. 10, a computer 50 is programmed to respond to depression of the character keys of the computer keyboard 52 to produce corresponding notes as noted on the keys 53 in FIG. 10. The elements in each row or along one dimension of the array of keys produce musical notes of increasing fundamental frequency $F_n$ according to the equation $$F_n = F_0 * 2^{n/8}$$

wherein $F_0$ is the fundamental frequency of the first note producing key in the one dimension and n is the number of the note producing key in the one direction from the first note producing element. Intervals between keys of the lower three rows correspond to perfect fourths while ten of the keys in the top row have octave intervals with keys in the lowest row.

Figure 11:
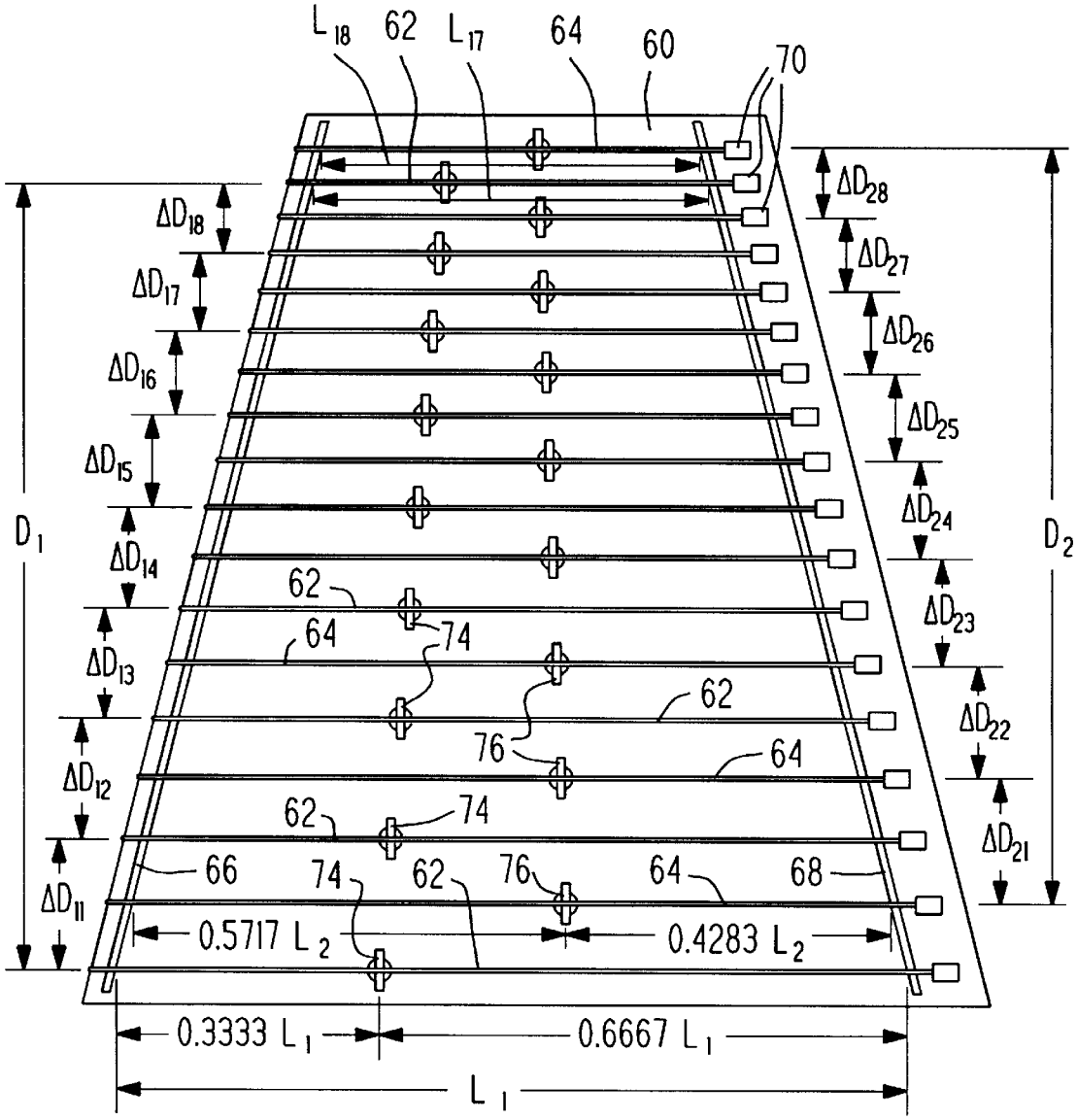
FIG. 11 is a plan view of a hammer dulcimer in accordance with the present invention.

A second variation of a hammer dulcimer illustrated in FIG. 11 includes a trapezoidal board or frame 60 across which extend first and second pluralities of alternating horizontal strings 62 and 64 held in engagement with opposite side bridges 66 and 68 by tension devices 70 on the right edge of the board 60 and by being suitably fastened on the left edge of the board 60. The first plurality of strings 62 form a first series with spacings $\Delta D_{11}$–$\Delta D_{18}$ and the second plurality of strings 64 form a second series with spacings $\Delta D_{21}$–$\Delta D_{28}$. Because of the trapezoidal shape the first and second series of alternating strings 62 and 64 have progressively shorter lengths $L_1$ through $L_{18}$ from bottom to top. Table 72 in FIG. 13 lists the relative lengths $L_{2n-1}$ and $L_{2n}$ for the respective first and second series of strings 62 and 64 along with the spacings $\Delta D_{11}$–$\Delta D_{18}$ and $\Delta D_{21}$–$\Delta D_{28}$ based upon the distances $D_1$ and $D_2$ between the top and bottom strings of the corresponding series 62 and 64. The strings 62 in the first series have lengths according to the equation $$L_1(n) = \frac{L_1}{2^{(n-1)/8}}$$

and the strings in the second series 64 have lengths according to the equation $$L_2(n) = \frac{L_2}{2^{(n-1)/8}}$$

wherein n is the number of the string in the corresponding series 62 and 64 beginning with the corresponding bottom string and $L_1$ and $L_2$ are the lengths of the corresponding bottom strings in the respective series 62 and 64.

Figures 12, 13:
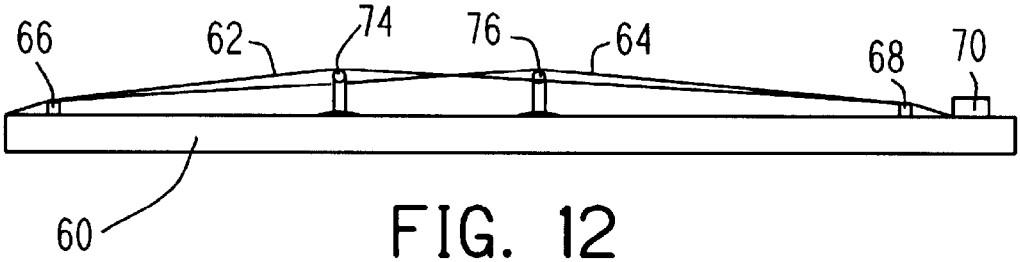
FIG. 12 is front view of the hammer dulcimer of FIG. 11.
FIG. 13 is a table illustrating string lengths and relative spacing of strings in first and second series of strings formed by alternate strings in the hammer dulcimer of FIG. 11.

Each of the first series of strings 62 is engaged intermediate its ends by a bridge 74, see FIG. 12, to divide each string into a left segment of length 0.3333*L and right segment of length 0.6667*L wherein L is the length of the string. Thus the first series of strings 62 produce notes on the left and right segments of each string with an octave interval, i.e. a fundamental frequency ratio of 2:1. Each of the second series of strings 64 is engaged intermediate its ends by a bridge 76 to divide each string into a left segment of length 0.5717*L and a right segment of length 0.4283 L wherein L is the length of the string. Thus the second series of strings 64 produce notes on the right and left segments of each string with a fourth interval, i.e. a fundamental frequency ratio of about 4:3 or $2^{5/12}$.

Figure 14:
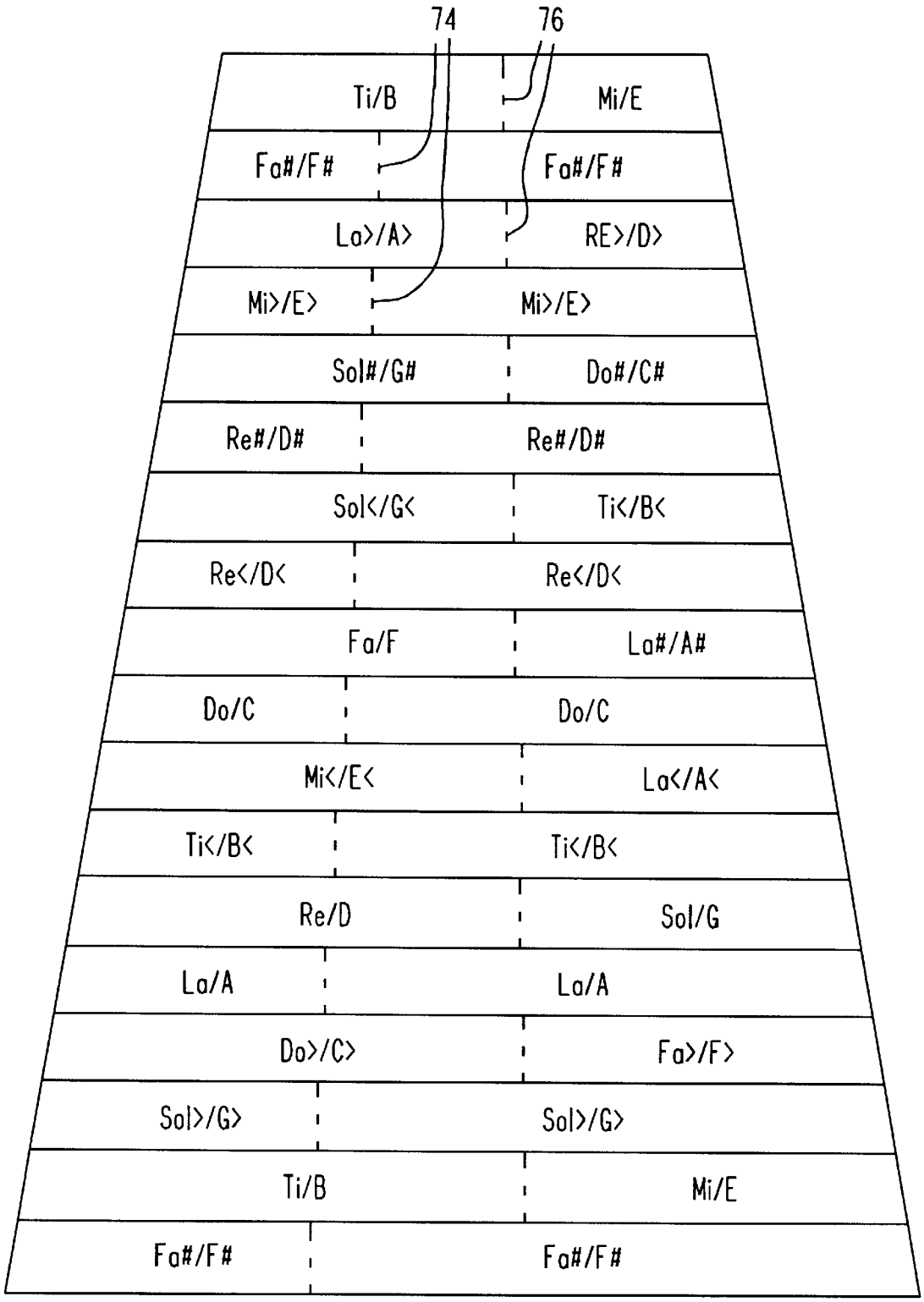
FIG. 14 is a table of possible notes produced by the the hammer dulcimer of FIG. 11.

The first series of strings 62 proceeding from the bottom to the top in each of the left and right segments produce notes of corresponding increasing frequency according to the equation $$F_n=F_0*2^{n/8}$$

wherein $F_0$ is the fundamental frequency of corresponding segment of the bottom string of series 62 and n is the number of the string in the series 62 in the up direction from the bottom string. Similarly the second series of strings 64 proceeding from the bottom to the top in each of the left and right segments produce notes of corresponding increasing frequency according to the equation $$F_n=F_0*2^{n/8}$$

wherein $F_0$ is the fundamental frequency of corresponding segment of the bottom string of series 64 and n is the number of the string in the series 64 in the up direction from the bottom string. Thus each of the corresponding series of strings 62 and 64 produce notes of three-quarter steps. The table in FIG. 14 illustrates one possible arrangement of notes produced by the two dimensional arrangement of note producing elements of FIG. 11.

In one preferred embodiment of FIG. 11, the trapezoidal arrangement of strings is an equilateral trapezoidal arrangement, i.e., the two non-parallel sides are of equal length and extend at equal opposite angles, and the distances $D_1$ and $D_2$ are equal to $L_{17}$ and $L_{18}$, respectively, which in turn are equal to $L_1/2$ and $L_2/2$, respectively. It is noted that such an equilateral trapezoid is formed by the bottom half of an isosceles triangle having a height equal to the base width. Thus the spacings $\Delta D_{10+n}$ and $\Delta D_{20+n}$ can be set as functions of $L_{2n-1}$ and $L_2n$, respectively, according to the equations:

$$\Delta D_{10+n} = \frac{L_{2n-1} - L_{2n+1}}{2}$$

and $$\Delta D_{20+n} = \frac{L_{2n} - L_{2n+2}}{2}.$$

Since many variations, modifications and changes in detail can be made to the embodiments described above and illustrated in the drawings, it is intended that all matter in the foregoing description and shown in the drawings be interpreted as illustrative and not as limiting to the scope of the invention as set forth in the following claims.

What is claimed is:

1. A musical instrument comprising:

a two dimensional array of note producing elements, each note producing element producing a note including a fundamental frequency and a plurality of harmonics of the fundamental frequency, the note producing elements in one direction along one dimension of said array including at least eight note producing elements having increasing fundamental frequencies $F_n$ according to the equation $$F_n=F_0*2^{n/8}$$

wherein $F_0$ is the fundamental frequency of the first note producing element in the one dimension and n is the number of the note producing element in the one direction from the first note producing element, and the note producing elements along a second dimension of said array having fundamental frequencies which differ by greater frequency differences than the frequency differences between adjacent note producing elements along the one dimension of said array.

2. A musical instrument according to claim 1 wherein fundamental frequencies of note producing elements differ from fundamental frequencies of adjacent note producing elements along said second dimension by the multiplier $2^{5/12}$.

3. A musical instrument according to claim 1 wherein said array of note producing elements comprises a two dimensional keyboard and a note generator responsive to depression of each key of the keyboard for generating a corresponding note.

4. A musical instrument according to claim 1 wherein the array of note producing elements comprises a string instrument having a plurality of parallel strings and a plurality of members transverse to the strings for changing the vibrating length of the strings.

5. A musical instrument according to claim 4 wherein the members are fret members spaced to change the fundamental vibrating frequency of the strings in accordance with the equation $$F_n=F_0*2^{n/8}.$$

6. A musical instrument according to claim 4 wherein the strings have increasing fundamental vibrating frequencies $F_n$ according to the equation $$F_n=F_0*2^{n/8}.$$

7. A musical instrument according to claim 6 wherein one of said members produces string sections along the parallel strings having fundamental frequencies differing by the multiplier $2^{5/12}$.

8. A musical instrument comprising:

first and second pluralities of parallel alternating strings wherein each of the first plurality of strings is divided into two string segments producing notes of a first interval and each of the second plurality of strings is divided into two string segments producing notes of a second interval different from the first interval, the first plurality of strings in the corresponding segments proceeding with successive strings producing corresponding notes of increasing fundamental frequencies $F_{1n}$ according to the equation $$F_{1n}=F_{10}*2^{1n/8}$$

wherein $F_{10}$ is the fundamental frequency of corresponding segments of a first string of the first plurality of strings and 1n is the number of the string in the first plurality of strings in one direction from the first string of the first plurality of strings, and the second plurality of strings in the corresponding segments proceeding with successive strings producing corresponding notes of increasing fundamental frequencies $F_{2n}$ according to the equation $$F_{2n}=F_{20}*2^{2n/8}$$

wherein $F_{20}$ is the fundamental frequency of corresponding segments of a first string of the second plurality of strings and 2n is the number of the string in the second plurality of strings in one direction from the first string of the second plurality of strings.

9. A musical instrument according to claim 8 wherein the first interval is an octave.

10. A musical instrument according to claim 8 wherein the second interval is a fourth.

11. A musical instrument according to claim 8 wherein the first interval is an octave and the second interval is a fourth.

12. A musical instrument according to claim 11 wherein a first segment of each string of the second plurality of strings produces a note which with a note produced by a first segment of a corresponding adjacent string of the first plurality of strings form a fourth interval.

* * * * *